US008267495B2

(12) United States Patent
Nozawa et al.

(10) Patent No.: US 8,267,495 B2
(45) **Date of Patent: *Sep. 18, 2012**

(54) LIQUID CONTAINER WITH RESIDUAL LIQUID QUANTITY DETECTING UNIT AND METHOD OF MANUFACTURING THE SAME

(75) Inventors: Izumi Nozawa, Nagano (JP); Hitotoshi Kimura, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 150 days.

This patent is subject to a terminal disclaimer.

(21) Appl. No.: 11/960,064

(22) Filed: Dec. 19, 2007

(65) Prior Publication Data

US 2008/0151017 A1 Jun. 26, 2008

(30) Foreign Application Priority Data

Dec. 26, 2006 (JP) ..... 2006-350225
Mar. 20, 2007 (JP) ..... 2007-073390

(51) Int. Cl.
*B41J 2/195* (2006.01)
*B41J 2/175* (2006.01)

(52) U.S. Cl. ..... 347/7; 347/86

(58) Field of Classification Search ..... 347/7
See application file for complete search history.

(56) References Cited

U.S. PATENT DOCUMENTS 5,561,496 A 10/1996 Sugiura et al.
5,988,783 A * 11/1999 Tajika et al. ..... 347/7
6,547,363 B1 4/2003 Shinada et al.
6,764,169 B2 * 7/2004 Hall et al. ..... 347/85
7,237,884 B2 * 7/2007 Sacco et al. ..... 347/86
7,311,388 B2 * 12/2007 Ogura et al. ..... 347/87
7,340,953 B2 * 3/2008 Green et al. ..... 73/428
7,424,824 B2 9/2008 Usui et al.
7,510,251 B2 3/2009 Wanibe et al.
7,552,999 B2 6/2009 Wanibe et al.
7,805,991 B2 10/2010 Usui et al.
2004/0252146 A1 * 12/2004 Naka et al. ..... 347/6
2006/0007259 A1 * 1/2006 Zhang ..... 347/7
2006/0017755 A1 * 1/2006 Shinada ..... 347/7
2006/0250426 A1 * 11/2006 Wanibe et al. ..... 347/7
2006/0251430 A1 * 11/2006 Wanibe et al. ..... 399/1
2007/0109368 A1 * 5/2007 Kimura ..... 347/86
2007/0188529 A1 * 8/2007 Zhang ..... 347/7
2008/0136878 A1 * 6/2008 Nozawa et al. ..... 347/86
2008/0151018 A1 * 6/2008 Aoki et al. ..... 347/86
2008/0239038 A1 * 10/2008 Yoshimoto et al. ..... 347/86
2009/0102880 A1 * 4/2009 Kimura ..... 347/19
2009/0262153 A1 * 10/2009 Tamaki et al. ..... 347/7

FOREIGN PATENT DOCUMENTS

CN 1840346 10/2006
CN 1840346 A 10/2006

(Continued)

*Primary Examiner* — Shelby Fidler
(74) *Attorney, Agent, or Firm* — Stroock & Stroock & Lavan LLP

(57) ABSTRACT

A liquid container includes a container body that accommodates a liquid containing portion containing a liquid. A residual liquid quantity detecting unit can be connected to the container body so as to detect a residual amount of liquid remaining in the liquid containing portion. A fitting mechanism, which allows the container body and the residual liquid quantity detecting unit to relatively rotate so as to be detachably attached to each other, may also be formed in a region where the container body and the residual liquid quantity detecting unit are connected to each other.

8 Claims, 10 Drawing Sheets

FOREIGN PATENT DOCUMENTS

| | | | |
|---|---|---|---|
| JP | 06-317954 | A | 11/1994 |
| JP | 2000-025299 | | 1/2000 |
| JP | 2001-328280 | A | 11/2001 |
| JP | 2003-011383 | A | 1/2003 |
| JP | 2004-122495 | | 4/2004 |
| JP | 2004-358912 | A | 12/2004 |
| JP | 2006-160371 | A | 6/2006 |
| JP | 2007-152821 | A | 6/2007 |

* cited by examiner

LIQUID CONTAINER WITH RESIDUAL LIQUID QUANTITY DETECTING UNIT AND METHOD OF MANUFACTURING THE SAME

BACKGROUND

1. Technical Field

The present invention relates to a liquid container and a method of manufacturing the liquid container, which supplies a predetermined liquid to a liquid consuming apparatus such as a liquid ejecting head or the like for ejecting a small amount of liquid droplets.

2. Related Art

When a liquid ejecting head of a printing apparatus, a microprocessor, or a commercial ink jet printing apparatus, which is used when a high quality printing is necessary, is operated in a state where a ejection liquid is supplied from a liquid container, but the liquid is not supplied to the liquid ejecting head, a so-called idle printing may occur, thereby damaging the liquid ejecting head. Accordingly, in order to prevent the idle printing, an amount of liquid remained in the liquid container has to be monitored.

In the printing apparatus, there have been proposed various methods of mounting a residual liquid quantity detecting unit for detecting an amount of residual ink in an ink cartridge, which is the liquid container for containing ink.

The ink cartridge mounted in the printing apparatus can be broadly classified into an air-open ink cartridge and an airtight ink cartridge.

In the air-open ink cartridge, an air introducing hole communicates with an ink container partitioned in the ink cartridge. In addition, since air pressure can be used to supply ink from the ink cartridge to the printing apparatus by introducing open air into the ink container with consumption of ink contained in the ink container, the configuration of the liquid container can be simplified. As a result, the ink air-open ink cartridge is suitable for a relatively small ink cartridge.

Alternatively, in the airtight ink cartridge, the ink cartridge is formed of a flexible bag having an airtight structure or the like, and thus degradation of ink occurring due to contact of open air can be prevented. Since quality of the contained ink can be reliably maintained for a long time, the airtight ink cartridge is suitable for a large-capacity ink cartridge. However, a pressing mechanism for pressing the flexible bag, which is the ink containing portion, from the outside may be provided. Accordingly, the size of the ink cartridge and the printing apparatus can be easily increased, compared with the air-open ink cartridge.

In a case where the residual liquid quantity detecting unit is provided with the ink cartridge, a problem arises in that the residual liquid quantity detecting unit has to be attached to a case (a container body) of the ink cartridge from the viewpoint of simplicity of a manufacturing process of the ink cartridge and improvement in productivity.

Presently, as the air-open ink cartridge capable of easily attaching the residual liquid quantity detecting unit to the case, there has been proposed an ink cartridge in which an attachment hole formed through the container body having the ink containing portion to communicate with the ink containing portion is formed and the residual liquid quantity detecting unit is rotated to be inserted into the attachment hole.

In this case, the residual liquid quantity detecting unit includes a cylindrical portion that is rotated to be fitted to the attachment hole, a locking piece that protrudes toward the outside of a radius direction from the outer circumferential surface of the cylindrical portion and is engaged in a locking portion provided in the container body to be fixed on the container body by rotation of the cylindrical portion, and a piezoelectric unit is laid in the cylindrical portion. The residual liquid quantity detecting unit is adapted to detect an amount of ink remaining in the ink container on the basis of residual vibration oscillated in the ink container by the piezoelectric unit.

In such an ink cartridge, the residual liquid quantity detecting unit is attached to the container body in a manner that the residual liquid quantity detecting unit is rotated to be inserted into the attachment hole formed on the container body, and thus the process of manufacturing the ink cartridge can be simplified to improve the productivity.

Patent Document 1: JP-A-2001-328280

However, in the case of the airtight ink cartridge, the above-described method of rotating the residual liquid quantity detecting unit to be inserted, which is used in the air-open ink cartridge, cannot be used.

In the case of the air-open ink cartridge, open air is introduced into an ink containing chamber with consumption of ink. Accordingly, since a vibration characteristic in the ink containing chamber considerably varies in accordance with the consumption of the ink, a piezoelectric unit can contribute to detect an amount of remaining ink with high precision by simply measuring residual vibration. As a result, it is also possible to make the piezoelectric unit compact.

In contrast, in the case of the airtight ink cartridge, even though ink is consumed, open air is not introduced into the ink containing chamber. Consequently, the amount of remaining ink cannot be measured with high precision by simply measuring the residual vibration in the air-open ink cartridge. For this reason, as a residual liquid quantity detecting unit, there has been proposed a unit that measures varying pressure (mass flow) in accordance with the amount of remaining ink. However, even in this case, since a flow passage for allowing the remaining ink to flow and a sensor for detecting variation in the ink flowing into the flow passage have to be provided, a problem arises in that the size of a residual liquid quantity detecting unit becomes larger.

SUMMARY

An advantage of some aspects of one embodiment of the invention is to provide a liquid container capable of suppressing increase in the size of an ink cartridge and a method of manufacturing the liquid container in a case where, for example, an airtight ink cartridge is used. The advantage can be attained by at least one of the following aspects:

(1) A first aspect of the invention provides a liquid container comprising: a container body that accommodates a liquid containing portion containing a liquid; and a residual liquid quantity detecting unit that is connected to the container body so as to detect a residual amount of liquid remaining in the liquid containing portion, wherein a fitting mechanism, which allows the container body and the residual liquid quantity detecting unit to relatively rotate so as to be detachably attached to each other, is formed in a region where the container body and the residual liquid quantity detecting unit are connected to each other.

With such a configuration, the attachment of the residual liquid quantity detecting unit to the container body can be completed by the fitting mechanism formed in a region where the residual liquid quantity detecting unit and the container body are connected to each other, in a simple manner that the residual liquid quantity detecting unit and the container body are connected to each other, and then the residual liquid quantity detecting unit and the container body relatively rotate.

(2) In the liquid container with the configuration described in (1), the fitting mechanism may include a detecting-unit fitting portion in which at least one convex wall or concave groove is formed in the container body and a container fitting portion which is fitted to the detecting-unit fitting portion and in which at least one convex wall or concave groove is formed in the residual liquid quantity detecting unit.

With such a configuration, the container fitting portion of the residual liquid quantity detecting unit is fitted to the detecting-unit fitting portion of the container body, and then the residual liquid quantity detecting unit is rotated around the circumference of the detecting-unit fitting portion of the container body. At this time, the convex wall or the concave groove which is the container fitting portion of the residual liquid quantity detecting unit is engaged in the convex wall or the concave groove which is the detecting-unit fitting portion of the container body. In this way, the residual liquid quantity detecting unit is fixed on the container body.

That is, the attachment of the residual liquid quantity detecting unit to the container body can be completed in the manner that the fitting portion of the residual liquid quantity detecting unit and the container body are fitted to each other, and then the residual liquid quantity detecting unit is rotated.

(3) In the liquid container with the configuration described in (2), the detecting-unit fitting portion may be an annular convex wall and the container fitting portion may be a annular convex wall which is rotatably fitted to the detecting-unit fitting portion.

With such a configuration, the inner circumference of the protrusion of one of the residual liquid quantity detecting unit and the container body comes in contact with the outer circumference of the other thereof, and the residual liquid quantity detecting unit is rotated. In this way, the residual liquid quantity detecting unit can be fitted to the detecting-unit fitting portion of the container body.

(4) The liquid container with the configuration described in one of (1) to (3) may further include: concave locking groove that is formed in the container body; and a locking piece that is formed in the residual liquid detecting unit and that engages with the locking groove.

With such a configuration, the locking piece formed in the residual liquid quantity detecting unit is engaged in the locking groove of the container body to fix the residual liquid quantity detecting unit on the container body by rotating the residual liquid quantity detecting unit.

(5) In the liquid container with the configuration described in one of (1) to (4), the fitting mechanism may have, with respect to an opening formed in the container body in order to connect a connection port formed in the liquid containing portion for leading out the liquid to a connection needle formed in the residual liquid quantity detecting unit, an eccentric state position where the connection needle deviates from a center of the opening and a center state position where the connection needle is located at the center of the opening.

With such a configuration, the connection needle is in the eccentric state position where the connection needle deviates from the center of the opening and the center state position where the connection needle is in the center of the opening. At this time, it is possible to suppress a rotation locus of the residual liquid quantity detecting unit by moving the eccentric state position and the center state position by rotation of the residual liquid quantity detecting unit (6) In the liquid container with the configuration described in (5), the fitting mechanism may be in an eccentric state when the detecting-unit fitting portion is fitted to the container fitting portion, and the fitting mechanism may be in a center state when the detecting-unit fitting portion is coupled with the container fitting portion.

With such a configuration, after the residual liquid quantity detecting unit is fixed on the container body by rotation of the residual liquid quantity detecting unit, the liquid containing portion is accommodated in the bag containing portion of the container body. In this way, the connection port of the liquid containing portion can be appropriately located in the connection needle of the residual liquid quantity detecting unit.

(7) A second aspect of the invention provides a method of manufacturing a liquid container having a container body that accommodates a liquid containing portion containing a liquid; and a residual liquid quantity detecting unit that is connected to the container body so as to detect a residual amount of liquid remaining in the liquid containing portion, the method comprising the steps of: fitting the container body and the residual liquid quantity detecting unit by a fitting mechanism, which is provided in a region where the container body and the residual liquid quantity detecting unit are connected to each other, and which allows the container body and the residual liquid quantity detecting unit to relatively rotate so as to be detachably attached to each other; coupling the container body and the residual liquid quantity detecting unit with each other by relatively rotating the container body and the residual liquid quantity detecting unit, after the fitting step; and connecting the residual liquid quantity detecting unit and the liquid containing portion to each other, after the coupling step.

With such a configuration, in order to attach the residual liquid quantity detecting unit to the container body, the region where the residual liquid quantity detecting unit and the container body are fitted to each other by the fitting mechanism equipped in the region where the residual liquid quantity detecting unit and the container body are connected to each other, and then the residual liquid quantity detecting unit and the container body are relatively rotated. Afterward, the manufacturing of the liquid container is completed by connecting the liquid containing portion to the residual liquid quantity detecting unit attached to the container body.

(8) In the method of manufacturing the liquid container described in (7), with respect to an opening formed in the container body in order to connect a connection port formed in the liquid containing portion for leading out the liquid to a connection needle formed in the residual liquid quantity detecting unit, the connection needle is in an eccentric state position where the connection needle deviates from a center of the opening in the fitting step, and the connection needle is in a center state position where the connection needle is located at the center of the opening in the coupling step.

With such a configuration, the residual liquid quantity detecting unit can be attached to the container body by making the rotation locus of the residual liquid quantity detecting unit small. In addition, the connection port of the liquid containing portion is connected to the connection port of the residual liquid quantity detecting unit located in the center of the opening of the container body.

(9) A third aspect of the invention provides a liquid container comprising: a container body that accommodates a liquid containing portion for containing a liquid; a connection port that is formed in the liquid containing portion to lead out the liquid; and a liquid lead-out portion that is formed in the container body to lead out the liquid led out from the connection port to the outside of the container body, wherein the liquid lead-out portion is provided at a deviated position from a center line of an opening of the connection port.

With such a configuration, the flow passage extending in the transverse direction of the container body is formed between the connection port and the liquid lead-out portion. Accordingly, the expanded size of the container body in the longitudinal direction can be minimized and the additional function unit can be provided in a part of the flow passage. As a result, it is possible to realize the compact liquid container having the residual liquid quantity detecting unit and the additional function unit such as the bubble trap chamber.

(10) In the liquid container with the configuration described in (9), the liquid lead-out portion may be disposed above the center line of the opening of the connection port in a heightwise direction when the liquid container is used.

With such a configuration, the liquid lead-out portion of the container body is located above the connection portion of the liquid containing portion when the liquid container is used. Accordingly, since pressure directly applied to the liquid lead-out portion is reduced by a difference of a liquid head, it is possible to prevent the liquid from leaking from the liquid lead-out portion.

BRIEF DESCRIPTION OF THE DRAWINGS

The invention will be described with reference to the accompanying drawings, wherein like numbers reference like elements.

FIG. 3(*b*) is an enlarged view illustrating an A part shown in FIG. 3(*a*).

DESCRIPTION OF EXEMPLARY EMBODIMENTS

Hereinafter, a liquid container according to an exemplary embodiment of the invention will be described in detail with reference to the drawings.

Figure 1:
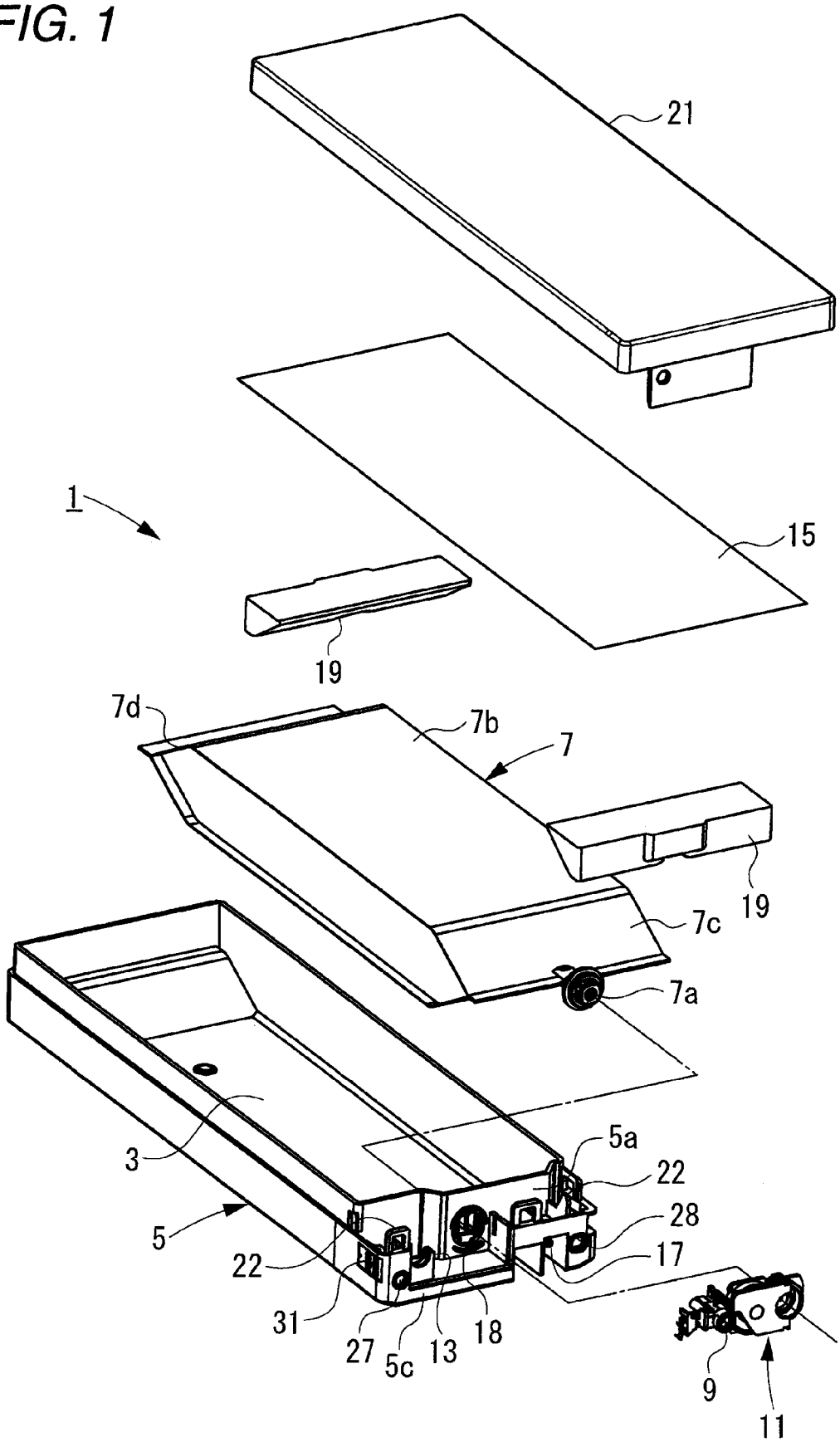
FIG. 1 is an exploded perspective view illustrating an ink cartridge according an embodiment.
Figure 2:
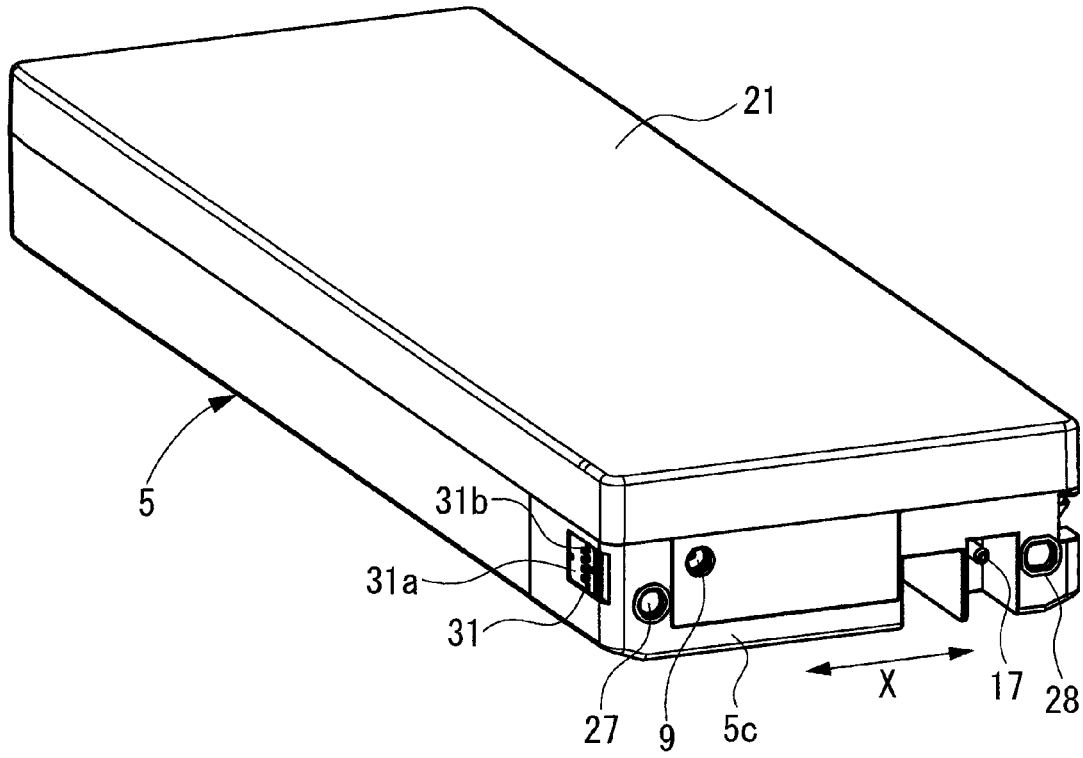
FIG. 2 is a perspective view illustrating the assembled ink cartridge.
Figure 3B:
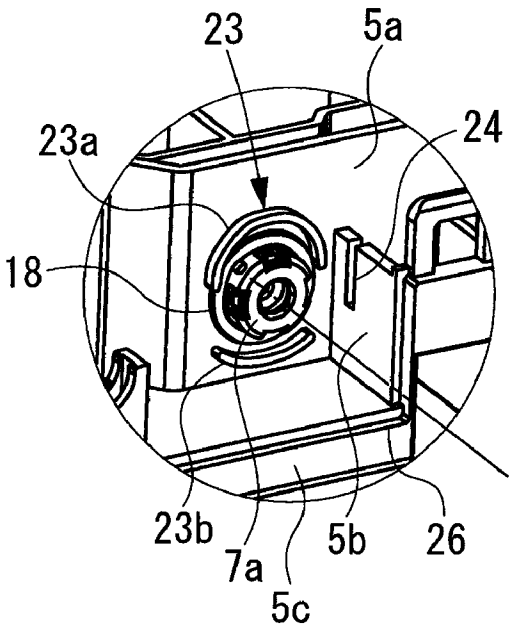
FIG. 3 (*a*) is a perspective view illustrating an ink pack mounted in a bag containing portion.
Figure 3A:
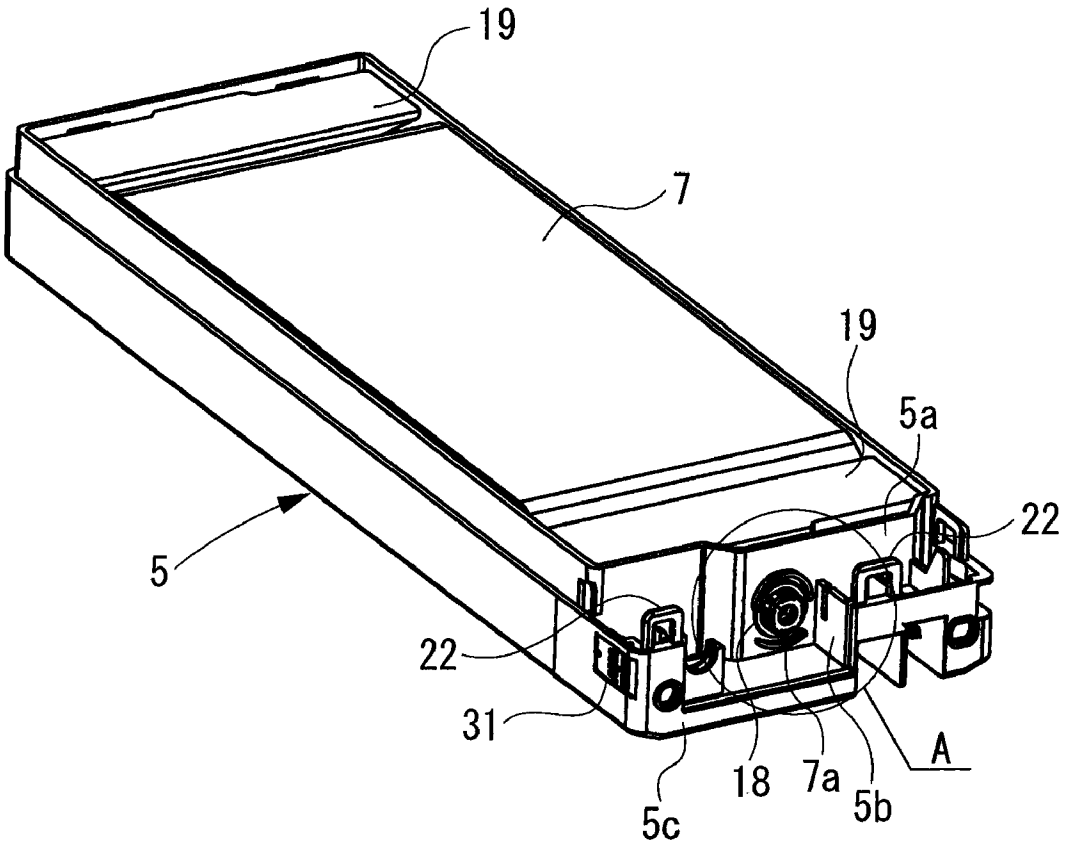
Figure 4:
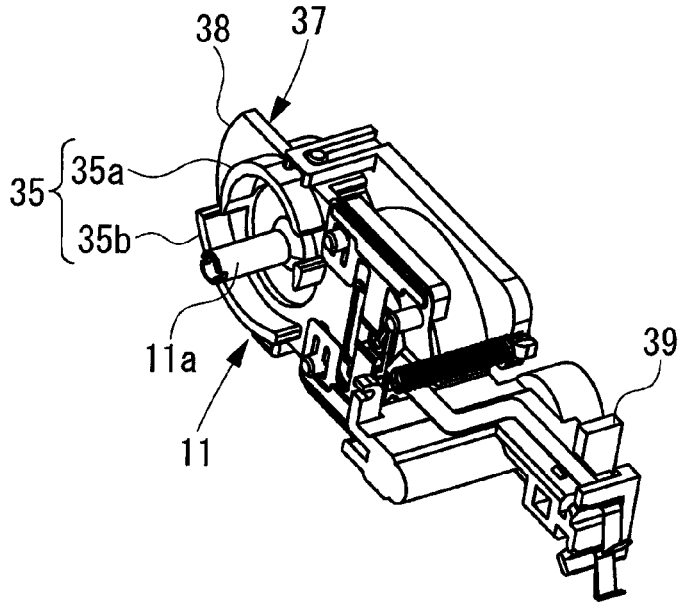
FIG. 4 is a perspective view illustrating a residual liquid quantity detecting unit when viewed from the rear side of the residual liquid quantity detecting unit.

FIG. 1 is an exploded perspective view illustrating an ink cartridge as one example of a liquid container according to an exemplary embodiment of the invention. FIG. 2 is a perspective view illustrating the assembled ink cartridge shown in FIG. 1. FIG. 3 (*a*) is a perspective view illustrating a state an ink pack which is a liquid containing portion and a spacer for filling up a space around the ink pack are mounted in a bag containing portion of a container body shown in FIG. 1. FIG. 3(*b*) is an enlarged view illustrating an A part shown in FIG. 3(*a*). FIG. 4 is a perspective view illustrating a residual liquid quantity detecting unit shown in FIG. 1 when viewed from the rear side of the residual liquid quantity detecting unit.

An ink cartridge 1 shown in FIGS. 1 and 2 is detachably mounted on a cartridge mount portion of a commercial ink jet printing apparatus and supplies ink a printing head (liquid ejecting head) equipped with the printing apparatus.

The ink cartridge 1 includes a container body 5 in which a bag containing portion 3 pressurized by a pressuring member is partitioned; an ink pack 7 which contains ink as a liquid containing portion, is accommodated in the bag containing portion 3, and discharges the ink contained by pressurization of the bag containing portion 3 through a connection port 7*a*; a residual liquid quantity detecting unit 11 which has a liquid lead-out portion 9 for supplying the ink to a printing head, which is an external liquid consuming apparatus, and is detachably mounted on the container body 5.

The container body 5 is a case formed by a resin molding. In the container body 5, the substantially rectangular bag containing portion 3 of which the upper portion is opened and a detecting-unit receiving portion 13 which is positioned in the front surface of the bag containing portion 3 so as to accommodate the residual liquid quantity detecting unit 11 are partitioned.

An opened surface of the bag containing portion 3 is sealed by a seal film 15 after the ink pack 7 is accommodated. In this way, the bag containing portion 3 becomes a sealed chamber.

In a partition wall 5*a* for partitioning the bag containing portion 3 and the detecting-unit receiving portion 13, there is provided a pressurizing port 17 which is a communication passage and formed in the sealed chamber to send pressuring air to the bag containing portion 3. When the ink cartridge 1 is mounted on the cartridge mount portion of the ink jet printing apparatus, the pressuring port 17 is connected to a pressurizing-air supplying member of the cartridge mount portion, so that the ink pack 7 by the pressurizing air supplied to the bag containing portion 3 can be pressurized.

In the ink pack 7, the cylindrical connection port 7*a* into which a connection needle 11*a* (see FIG. 4) of the residual liquid quantity detecting unit 11 is inserted to be connected thereto is bonded to one end of a flexible bag 7*b* formed of an aluminum-laminated multilayer film in which an aluminum layer is laminated on a resin film layer. The use of the aluminum-laminated multilayer film ensures a high gas barrier property.

A specific structure of the liquid containing portion is not limited to the ink pack 7. For example, the flexible bag is not used, but a container may be filled with ink and the ink may be covered with a film or the like.

As shown in FIG. 3, the front end of the connection port 7*a* of the ink pack 7 is air-tightly inserted into a connection-port insertion opening 18 formed on the partition wall 5*a* to protrude in the detecting-unit receiving portion 13.

Ink deaerated in advance is filled in the ink pack 7 before the residual liquid quantity detecting unit 11 is connected.

When the ink pack 7 is mounted on the bag containing portion 3, resin spacers 19 are mounted on inclined portions 7*c* and 7*d* in the front and rear of the flexible bag 7*b*, respectively. When the upper surface of the bag containing portion 3 is covered with a seal film 15, so that the bag containing portion 3 becomes the sealed chamber, the resin spacers 19 prevents the ink pack 7 from shaking in the sealed chamber and pressure caused by movement of the ink contained in the ink pack 7 from being focused on a welding portion of the ink pack 7 at the time of falling.

A resin cover 21 is mounted on the seal film 15 sealing the opened surface of the detecting-unit receiving portion 13 in addition to the bag containing portion 3. When the container body 5 is covered with the resin cover 21, an engagement member (not shown) is engaged in an engagement portion 22 of the container body 5 to be fixed on the container body 5.

As shown in FIG. 3(*b*), as a connection portion, a detecting-unit fitting portion 23 in which the residual liquid quantity detecting unit 11 is fitted so as to be relatively rotatable is provided around the opening 18 opened to the partition wall 5*a*.

In this embodiment, the detecting-unit fitting portion 23 has two incurved convex walls 23*a* and 23*b*. In addition, the detecting-unit fitting portion 23 has an annular shape for regulating a rotation center of the residual liquid quantity detecting unit 11 by the convex walls 23*a* and 23*b*.

As shown in FIG. 3 (*b*), a locking groove 24 for preventing the residual liquid quantity detecting unit 11 fitted to the detecting-unit fitting portion 23 is formed near the detecting-unit fitting portion 23. In addition, the locking groove 24 is formed in a partition wall 5*b* erected in the detecting-unit receiving portion 13 so as to be perpendicular to the partition wall 5*a*.

In order to attach the residual liquid quantity detecting unit 11, an opening 26 notched at a position where it is opposite the detecting-unit fitting portion 23 is formed on a front surface wall 5*c* of the container body 5 which is a partition wall for covering the entire surface of the detecting-unit receiving portion 13.

On both the sides of the front surface wall 5*c*, as shown in FIG. 2, there are positioning holes 27 and 28 into which positioning pins equipped with the cartridge mount portion are inserted when the ink cartridge 1 is mounted on the cartridge mount portion.

The positioning hole 27 is configured as a round hole and the positioning hole 28 is configured as a longitudinal narrow hole in a transverse direction (an arrow X direction in FIG. 2) of the container body 5. The positioning hole 28 configured as the longitudinal hole allows a positioning precision to be maintained and size tolerance is easily allowed.

On the side wall of the container body 5 close to the positioning hole 27, which is the round hole, a circuit board 31 which comes in contact with a connection terminal of the cartridge mount portion so as to be electrically connected to the connection terminal when the ink cartridge 1 is mounted on the cartridge mount portion is formed at a position close to the front surface.

The circuit board 31 allows a memory element disposed in the rear surface of the circuit board 31 or a piezoelectric element mounted on the residual liquid quantity detecting unit 11 to be electrically connected to a control circuit of the ink jet printing apparatus. Thus, the circuit board 31 allows an operation of the memory element or the piezoelectric element to be controlled from the printing apparatus.

In this embodiment, as shown in FIGS. 1 and 4, the residual liquid quantity detecting unit 11 includes a container fitting portion 35 which is fitted to the detecting-unit fitting portion 23 (see FIG. 3) of the container body 5 as a connection portion so as to be relatively rotatable; a fixation member 37 which is fixed on the container body 5 in a manner of fitting the container fitting portion 35 into the detecting-unit fitting portion 23 to rotate the residual liquid quantity detecting unit 11; an inner flow passage (not shown) which guides the ink contained in the flexible bag 7*b* to the liquid lead-out portion 9 through the connection needle 11*a* connected to the connection port 7*a*; and a sensor (not shown) which detects an amount of remaining ink by using an ink inflow state (variation in pressure) of the inner flow passage.

In this embodiment, the container fitting portion 35 can be attached to or detached from the convex walls 23*a* and 23*b* of the detecting-unit fitting portion 23. Moreover, the container fitting portion 35 has two curved convex walls 35*a* and 35*b* fitted so as to be rotatable and has an annular shape for regulating the rotation center of the residual liquid quantity detecting unit 11 by the convex walls 35*a* and 35*b*.

With such a configuration, the detecting-unit fitting portion 23 formed in the partition wall 5*a* and the container fitting portion 35 formed in the residual liquid quantity detecting unit 11 constitute a fitting mechanism for connecting the container body 5 with the residual liquid quantity detecting unit 11 so as to be relatively rotatable.

The fixation member 37 is constituted by a locking piece 38 protruding from the outer circumference of the container fitting portion 35 and an engagement portion 39 formed on the front end of the residual liquid quantity detecting unit 11 which rotatably moves.

Figure 5:
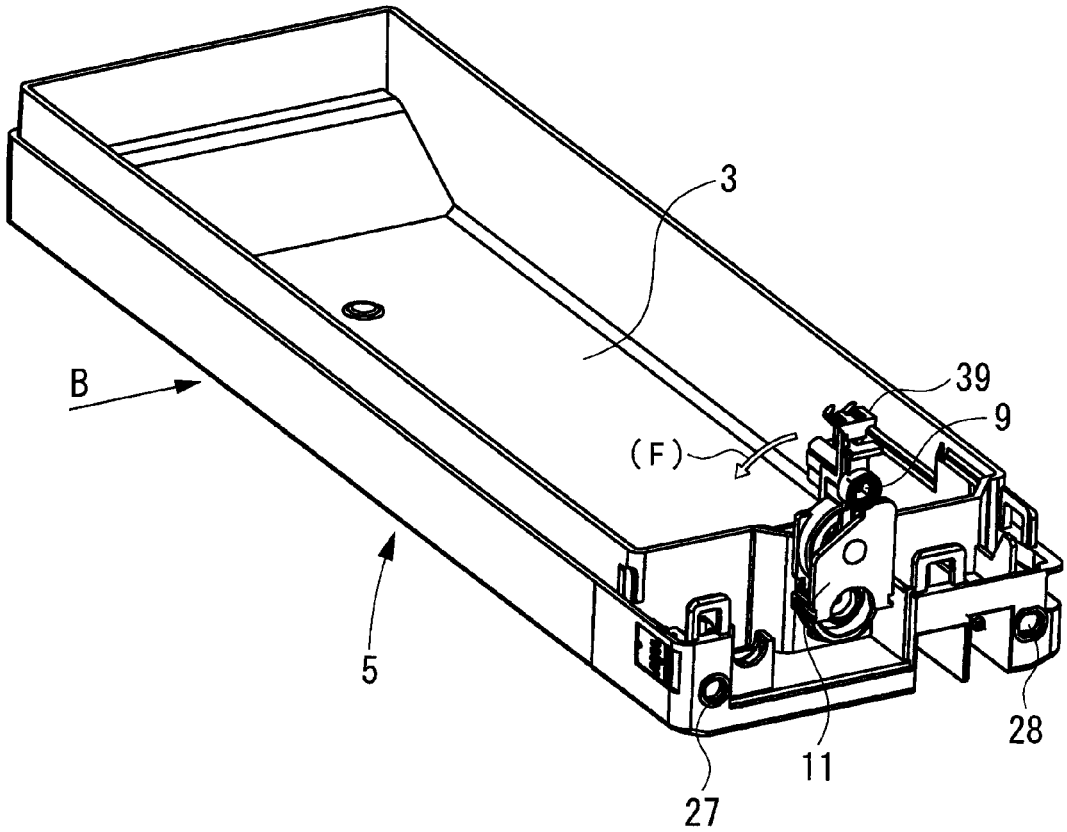
FIG. 5 is a perspective view the residual liquid quantity detecting unit fitted to a detecting-unit fitting portion.
Figure 8:
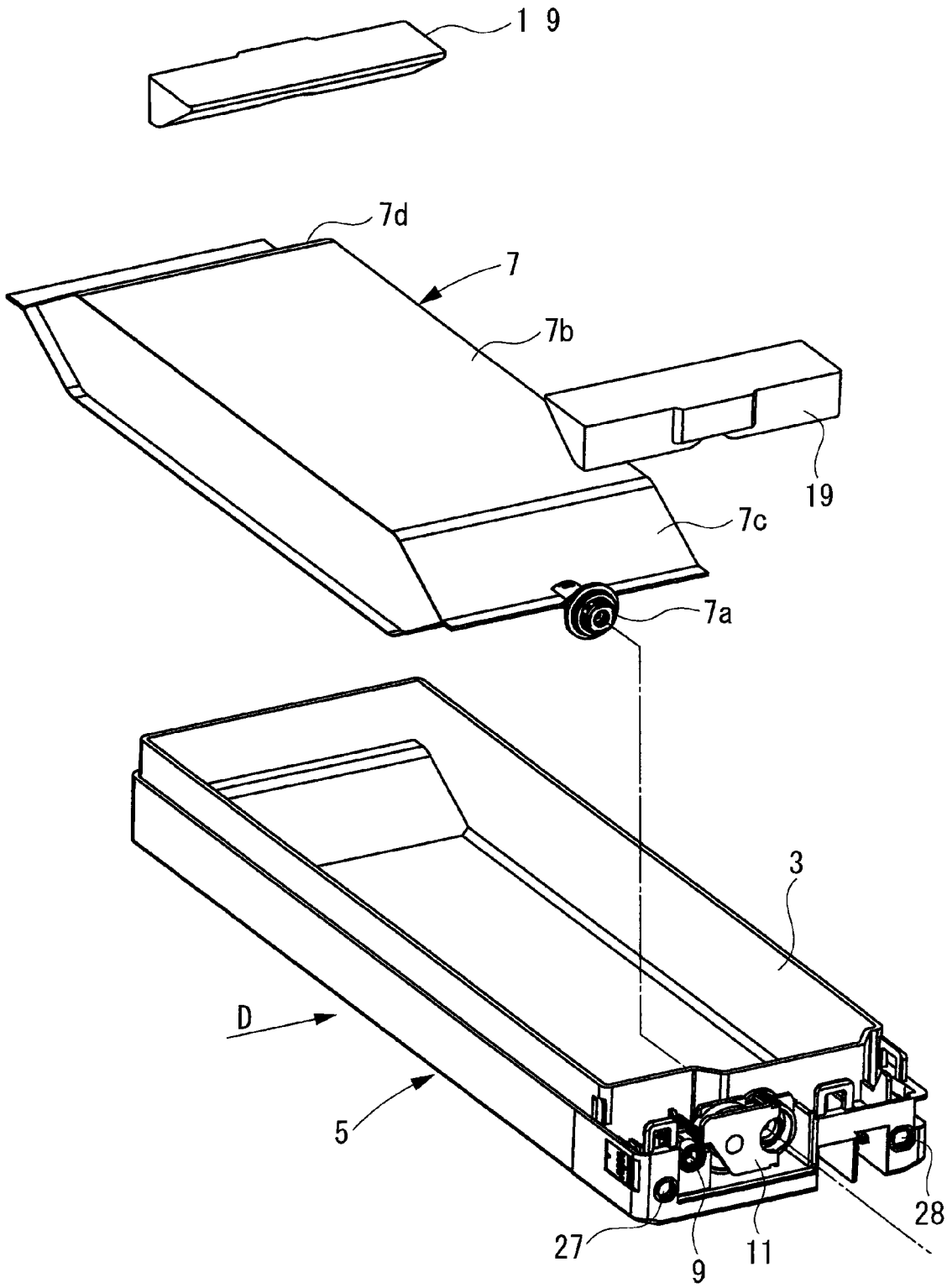
FIG. 8 is a perspective view illustrating an assembly process of the container body.
Figure 10:
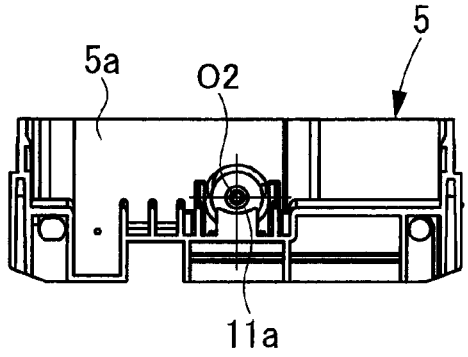
FIG. 10 is a sectional view illustrating the container body taken along the line E-E shown in FIG. 9.
Figure 11:
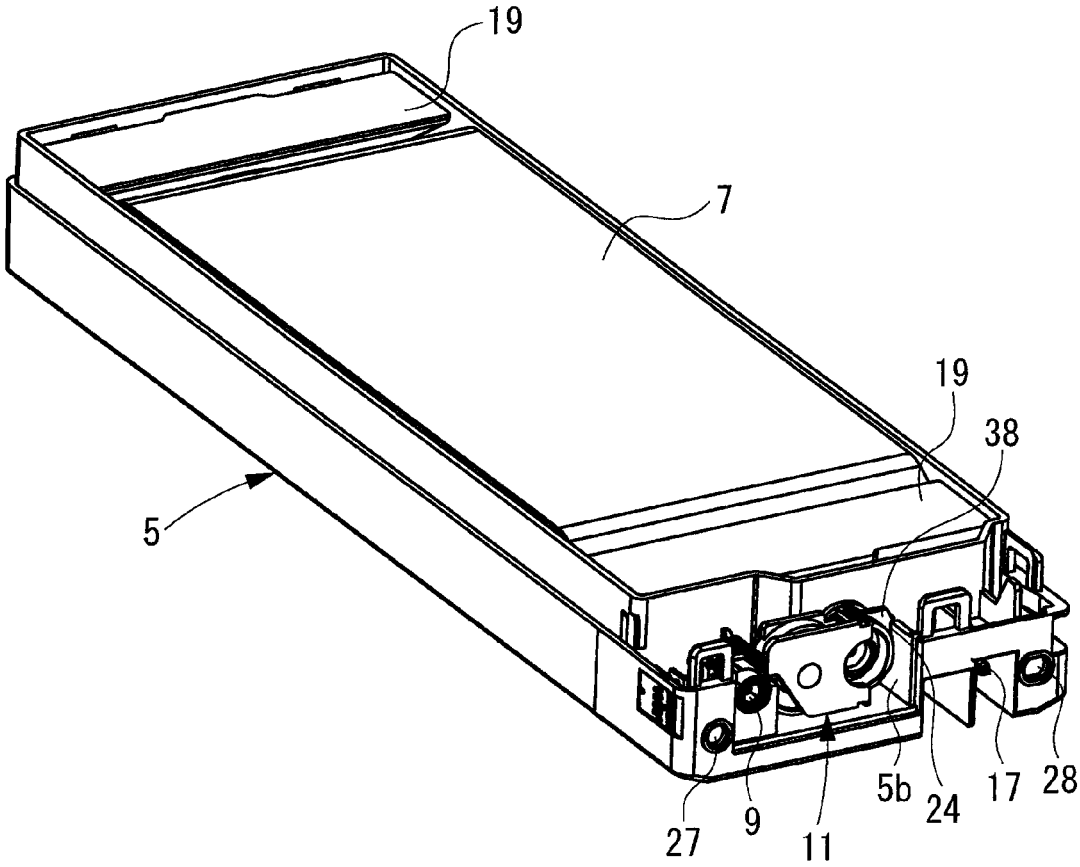
FIG. 11 is a perspective view illustrating the container body when the assembly process shown in FIG. 8.

In FIG. 5, when the container fitting portion 35 is fitted to the detecting-unit fitting portion 23, and then the residual liquid quantity detecting unit 11 is rotated in a narrow (F) direction, the locking piece 38 is engaged into the locking groove 24 (see FIG. 3) of the container body 5. Accordingly, as shown in FIGS. 8 and 10, it is possible to prevent the container fitting portion 35 from coming out to the side of the cartridge mount portion. Meanwhile, in FIG. 5, when the container fitting portion 35 is fitted to the detecting-unit fitting portion 23, and then the residual liquid quantity detecting unit 11 is rotated in the arrow (F) direction, the engagement portion 39 is engaged in an engagement portion of the container body 5 to regulate the rotation of the residual liquid quantity detecting unit 11.

Figure 7:
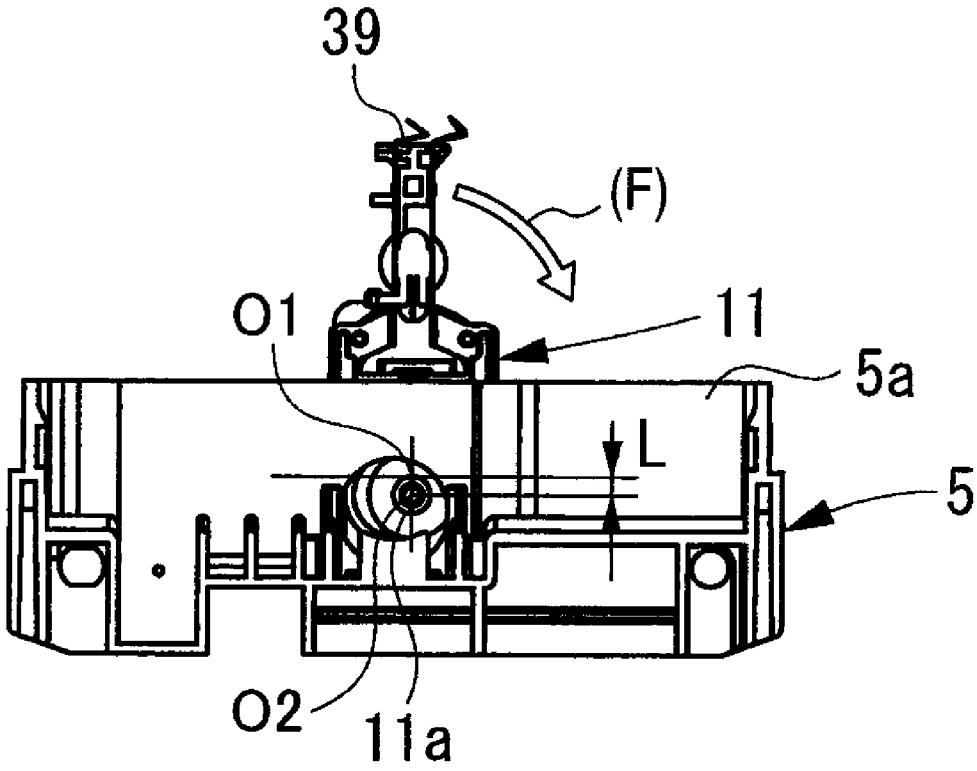
FIG. 7 is a sectional view illustrating the container body taken along the line C-C shown in FIG. 6.

In this embodiment, as shown in FIG. 7, a rotation center O1 of the container fitting portion 35 is configured to deviate from a center O2 of the connection needle 1*a* toward the opened surface of the container body 5 by a distance L.

Figure 9:
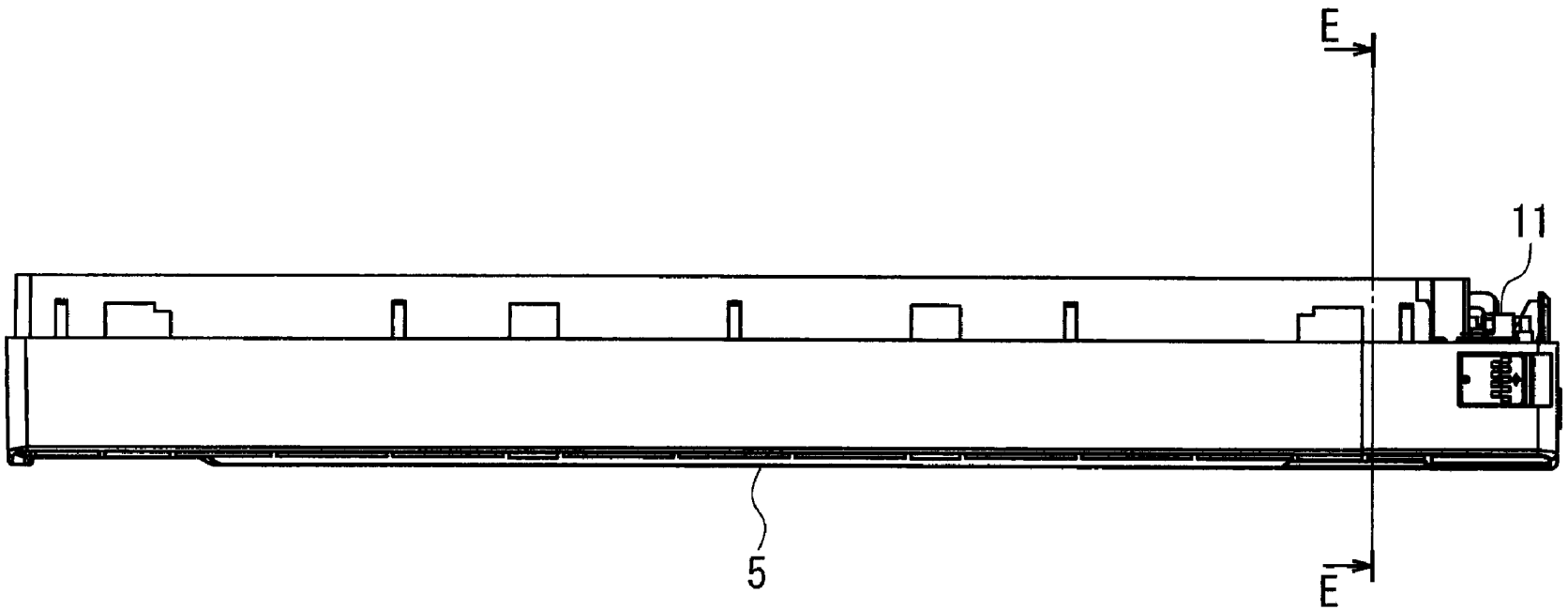
FIG. 9 is a diagram illustrating the container body when viewed in an arrow D shown in FIG. 8.

As shown in FIGS. 9 and 10, the container fitting portion 35 of the residual liquid quantity detecting unit 11 is fitted to the detecting-unit fitting portion 23 of the container body 5 so that the locking piece 38 is engaged in the locking groove 24 by the rotation of the residual liquid quantity detecting unit 11. At this time, an eccentric quantity of the rotation center O1 and the center O2 is set so that the connection needle 11*a* is positioned at a substantial center of the connection port 7*a* of the ink pack 7 accommodated in the bag containing portion 3 of the container body 5.

In other word, in the state where the residual liquid quantity detecting unit 11 is fitted to the container body 5, the connection needle 11*a* is configured to be in an eccentric state where the connection needle 11*a* deviates from the center of the opening 18 opened to the partition wall 5*a*. When the residual liquid quantity detecting unit 11 is coupled with the container body 5, the connection needle 11*a* is configured to be in a center state of the opening 18. Accordingly, the residual liquid quantity detecting unit 11 can be changed to the eccentric state or the center state by the rotation operation so as to make rotation locus small.

Figure 6:
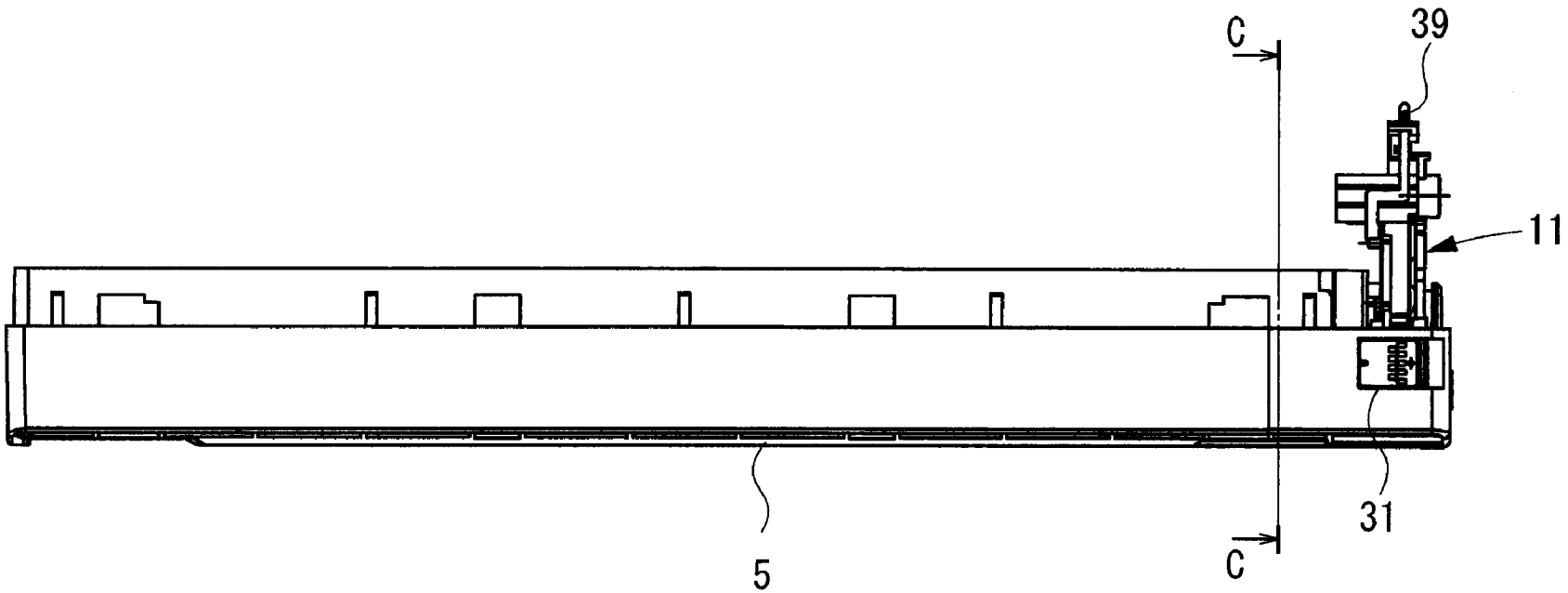
FIG. 6 is a diagram illustrating a container body when viewed in an arrow B shown in FIG. 5.

According to the ink cartridge 1 described above, as shown in FIGS. 5 to 7, after the container fitting portion 35 of the residual liquid quantity detecting unit 11 is fitted to the detecting-unit fitting portion 23 of the container body 5, the residual liquid quantity detecting unit 11 is rotated around the circumference of the container fitting portion 35 in the arrow (F)

direction shown in FIG. 5. At this time, the locking piece 38 protruding from the outer circumference of the container fitting portion 35 is engaged in the locking groove 24 of the container body 5, and the engagement portion 39 is also engaged in the engagement portion of the container body 5. Accordingly, the residual liquid quantity detecting unit 11 is fixed on the container body 5.

That is, the residual liquid quantity detecting unit 11 is attached to the container body 5 for accommodating the ink pack 7 in a simple manner that the fitting portions 35 and 23, which are a fitting mechanism equipped in the portion connected to each others are fitted, and then the residual liquid quantity detecting unit 11 is rotated. Consequently, it is easy to assemble the ink cartridge 1, and thus it is possible to improve productivity of the ink cartridge 1.

Additionally, since the rotation center O1 of the container fitting portion 35 is configured to deviate from the center O2 of the connection needle 11*a*, it is possible to suppress the rotation locus of the locking piece 38 of the residual liquid quantity detecting unit 11 engaged in the container body 5 by rotation operation. Accordingly, the position of the locking groove 24 equipped in the container body 5 can be disposed nearer at the rotation center of the residual liquid quantity detecting unit 11 or the depth of the locking groove 24 can be reduced. As a result, the container body 5 is made small, and thus it is possible to suppress the size of the ink cartridge 1.

In the ink cartridge 1 according to the above-described embodiment, the container fitting portion 35 of the residual liquid quantity detecting unit 11 is fitted to the detecting-unit fitting portion 23 of the container body 5, and engagement of the locking piece 38 in the locking groove 24 is completed by the rotation of the residual liquid quantity detecting unit 11. At this time, as shown in FIG. 10, the connection needle 11*a* is positioned at the substantial center of the connection port 7*a* of the ink pack 7 accommodated in the bag containing portion 3 of the container body 5.

For this reason, as shown in FIG. 8, a manufacturing method of fixing the residual liquid quantity detecting unit 11 on the container body 5 by operating the rotation of the residual liquid quantity detecting unit 11, and then setting the ink pack 7 in the bag containing portion 3 of the container body 5 can be used. Then, since the connection port 7*a* of the ink pack 7 can be appropriately positioned at the connection needle 11*a* of the residual liquid quantity detecting unit 11, the residual liquid quantity detecting unit 11 and the ink pack 7 can be easily connected to each other. As a result, it is possible to further improve the assembly of the ink cartridge 1.

In the ink cartridge 1 according to the above-described configuration, the detecting-unit fitting portion 23 of the container body 5 and the container fitting portion 35 of the residual liquid quantity detecting unit 11 are all configured to be rotatably fitted to the mutual annular structures by one or more convex walls, and the convex walls are intermittently formed. Consequently, it is possible to improve a manufacturing property in a molding process, comparing with a case where the detecting-unit fitting portion 23 and the container fitting portion 35 have a cylindrical structure so as to be fitted to each other. As a result, it is easier to manufacture the detecting-unit fitting portion 23 or the container fitting portion 35.

The specific structure of the detecting-unit fitting portion 23 or the container fitting portion 35 is not limited to that according to the above-described configuration. In this embodiment, the detecting-unit fitting portion 23 or the container fitting portion 35 is formed of two convex walls. However, the annular structure for regulating the rotation center may be formed of one or three or more convex walls. Moreover, instead of the convex wall, the annular structure for regulating the rotation center may be formed of at least one concave groove.

As shown in FIG. 8, a position of the connection port 7*a* and a position of the liquid lead-out portion 9 deviate from each other in right and left directions (an arrow D direction in FIG. 8) in the drawing. In addition, the liquid lead-out portion 9 is formed at an offset position where the liquid lead-out portion 9 and the connection port 7*a* deviate from each other.

At the time the ink cartridge 1 attached to the ink jet printing apparatus is actually used, the ink cartridge 1 shown in FIG. 8 is rotated by 90° in a clockwise direction. For this reason, the liquid lead-out portion 9 is located in a more upper portion than a center line S of the opening of the connection port 7*a*. The center line S passes through the center of the opening of the connection port 7*a* and is a line extending in a direction perpendicular to a surface of the opening (or a surface to which the connection 7*a* is attached in the container body 5) of the connection port 7*a*.

In this way, since the liquid lead-out portion 9 is located above the connection port 7*a* of the ink pack 7 when the liquid cartridge 1 is used, pressure applied to the liquid lead-out portion 9 is reduced by a difference of a liquid head. Consequently, it is possible to prevent ink from leaking from the liquid lead-out portion 9. That is, a flow passage of the ink from connection port 7*a* becomes a flow passage vertically ascending from the connection port 7*a* to the liquid lead-out portion 9. In this ascending flow passage, since the gravity of the ink is excluded from the pressure of the ink, the pressure of the ink applied to the liquid lead-out portion 9 is reduced.

In the ink cartridge 1 according to the above-described embodiment, the inner flow passage of the residual liquid quantity detecting unit 11 is configured as a flow passage that is formed between the connection port 7*a* and the liquid lead-out portion 9 and extends in a transverse direction (an arrow X direction in FIG. 2) of the container body 5. In addition, as an additional function unit formed a part of the flow passage, the residual liquid quantity detecting unit 11 is provided. However, the additional function portion according to this embodiment is not limited thereto.

Figure 12:
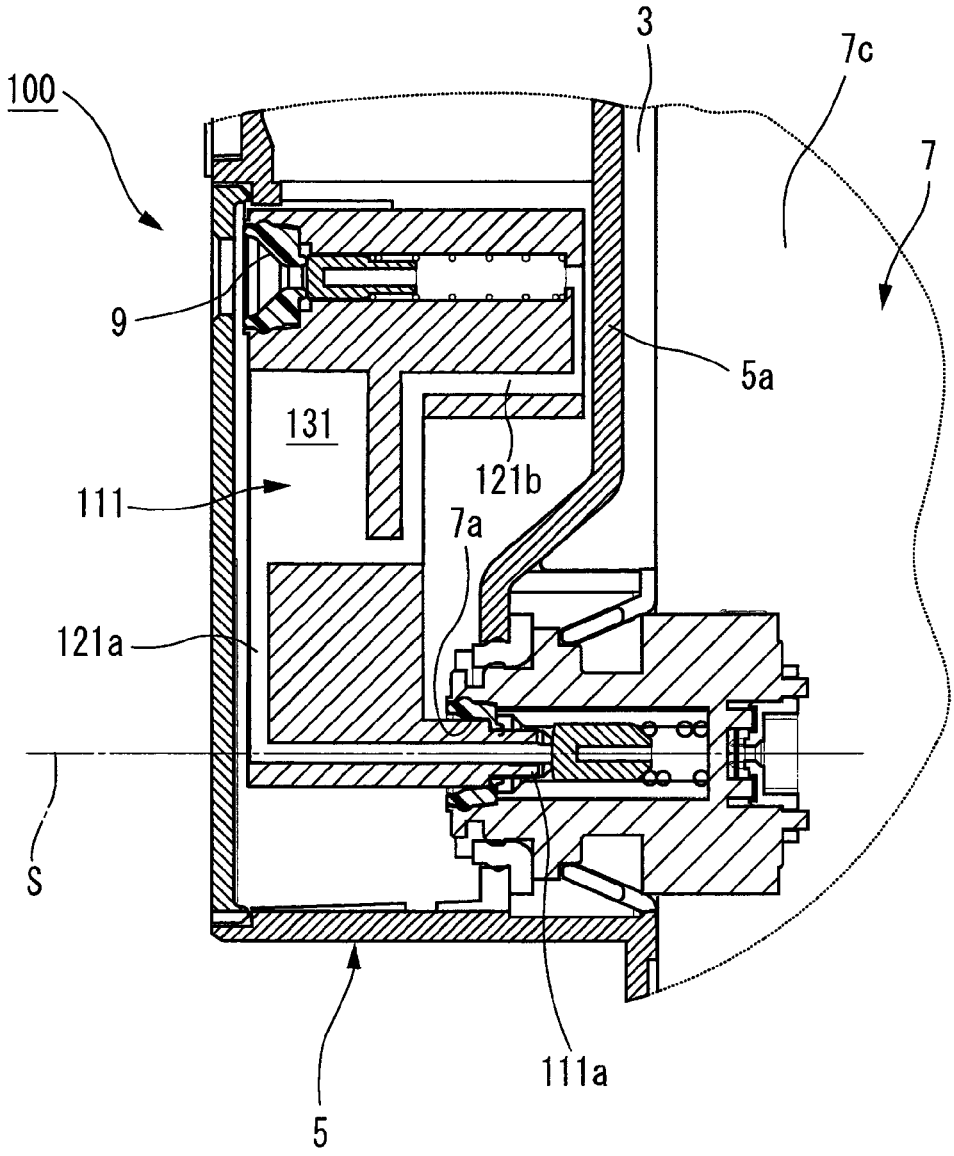
FIG. 12 is an enlarged sectional view illustrating major elements of the ink cartridge according to another embodiment.

For example, instead of the residual liquid quantity detecting unit 11 of the ink cartridge 1 according to the above-described embodiment, an ink cartridge 100 according to another embodiment shown in FIG. 12 is provided as a liquid container in which a bubble-trapping unit 111 is formed as an additional function unit between a connection port 7*a* and a liquid lead-out portion 9.

The same reference numerals are given to the same elements as those of the ink cartridge 1 according to the above-described embodiment, and the detailed description is omitted.

As shown in FIG. 12, the ink cartridge 100 includes inner flow passages 121*a* and 121*b* and a trap chamber 131, which are configured as a flow passage formed between the connection port 7*a* and the liquid lead-out portion 9 to extend in a transverse direction (vertical direction in FIG. 12) of a container body 5. In addition, as the additional function unit formed at a part of the flow passage, the bubble-trapping unit 111 is provided.

Accordingly, ink and bubbles of the ink contained in an ink pack 7 and the inner flow passage 121*a* are not supplied together to a printing head from the liquid lead-out portion 9. As a result, it is possible to maintain good print quality of the printing head. That is, even when the bubbles occur in the ink contained in the ink pack 7 and the inner flow passage 121*a* due to open air penetrated into a flexible bag 7*b* of the ink pack 7 or low deaerated ink flowing backward from the liquid lead-out portion 9, the bubbles in the flow passage are trapped in the trap chamber 131 and do not flow from the inner flow passage 121 to the liquid lead-out portion 9.

Therefore, in the ink cartridges 1 and 100 according to the above-described embodiments, the liquid lead-out portion 9 is formed at a position where the liquid lead-out portion 9 deviates from the center line S of the opening of the connection port 7*a*, so that the flow passage extending in the transverse direction of the container body 5 between the connection port 7*a* and the liquid lead-out portion 9 is formed. Consequently, it is possible to minimize the size of the liquid container 5 in a longitudinal direction of the liquid container 5 and provide the additional function unit such as the above-described residual liquid quantity detecting unit 11 or the bubble-trapping unit 111 in the flow passage.

The liquid container according to the invention is not limited to the ink cartridge of the ink jet printing apparatus, but may be applied to various liquid consuming apparatus provided with a liquid ejecting head.

Specific examples of the liquid consuming apparatus include an apparatus provided with a color-material ejecting head used to manufacture a color filter such as that used in a liquid crystal display, an apparatus provided with an electrode-material (conductive paste) ejecting head used to form an electrode such as that used in an organic EL display or a plane emission display (FED), an apparatus provided with a bio-organism ejecting head used to manufacture a bio chip, an apparatus provided with a sample ejecting head as a precision pipette, a printing apparatus, and a microprocessor.

This application claims priority from Japanese Patent Application Nos. 2006-350225 filed on Dec. 26, 2006 and 2007-073390 filed on Mar. 20, 2007, the entire disclosure of which are expressly incorporated by reference herein.

While this invention has been described in conjunction with the specific embodiments thereof, it is evident that many alternatives, modifications, and variations will be apparent to those skilled in the art. Accordingly, preferred embodiments of the invention as set forth herein are intended to be illustrative, not limiting. There are changes that may be made without departing from the sprit and scope of the invention.

What is claimed is:

1. A liquid container to be mounted in a liquid consuming apparatus, the liquid container comprising:

a container body comprising a front face having a connection-port insertion opening, the container body accommodating a liquid containing portion containing a liquid, the liquid containing portion provided with a connection port for leading out the liquid, the connection port configured to be inserted into the connection-port insertion opening;

a residual liquid quantity detecting unit provided at the front face, the residual liquid quantity detecting unit connected to the connection port so as to detect a residual amount of liquid remaining in the liquid containing portion, the residual liquid quantity detecting unit having a liquid lead-out portion configured to supply the liquid to the liquid consuming apparatus; and a fitting mechanism, which allows the container body and the residual liquid quantity detecting unit to be detachably attached to each other, and which is formed in a region where the container body and the residual liquid quantity detecting unit are connected to each other.

2. The liquid container according to claim 1, wherein the fitting mechanism includes: a detecting-unit fitting portion in which at least one convex wall or concave groove is formed in the container body; and a container fitting portion which is fitted to the detecting-unit fitting portion and in which at least one convex wall or concave groove is formed in the residual liquid quantity detecting unit.

3. The liquid container according to claim 2, wherein the detecting-unit fitting portion is an annular convex wall and the container fitting portion is an annular convex wall which is rotatably fitted to the detecting-unit fitting portion.

4. The liquid container according to claim 1, further comprising:

a concave locking groove that is formed in the container body; and a locking piece that is formed in the residual liquid detecting unit and that engages with the locking groove.

5. A liquid container to be mounted in a liquid consuming apparatus, the liquid container comprising:

a container body that accommodates a liquid containing portion containing a liquid, the liquid containing portion provided with a connection port for leading out the liquid;

a residual liquid quantity detecting unit that is connected to the connection port so as to detect a residual amount of liquid remaining in the liquid containing portion, the residual liquid quantity detecting unit having a liquid lead-out portion configured to supply the liquid to the liquid consuming apparatus; and a fitting mechanism, which allows the container body and the residual liquid quantity detecting unit to be detachably attached to each other, and which is formed in a region where the container body and the residual liquid quantity detecting unit are connected to each other;

wherein the container body is formed with an opening through which the connection port and a connection needle formed in the residual liquid quantity detecting unit are connected to each other, and the fitting mechanism is in:

an eccentric state where the connection needle deviates from a center of the opening; or a center state where the connection needle is located at the center of the opening.

6. The liquid container according to claim 5, wherein the fitting mechanism includes:

a detecting-unit fitting portion in which at least one convex wall or concave groove is formed in the container body; and a container fitting portion which is fitted to the detecting-unit fitting portion and in which at least one convex wall or concave groove is formed in the residual liquid quantity detecting unit, the fitting mechanism is in the eccentric state when the detecting-unit fitting portion is fitted to the container fitting portion, and the fitting mechanism is in the center state when the detecting-unit fitting portion is coupled with the container fitting portion.

7. A method of manufacturing a liquid container to be mounted in a liquid consuming apparatus, the liquid container having a container body that comprises a front face having a connection-port insertion opening, the container body accommodating a liquid containing portion containing a liquid, the liquid containing portion provided with a connection port for leading out the liquid, the connection port configured to be inserted into the connection-port insertion opening; and a residual liquid quantity detecting unit provided in the front face, the residual liquid quantity detecting unit connected to the connection port so as to detect a residual amount of liquid remaining in the liquid containing portion, the residual liquid quantity detecting unit having a liquid lead-out portion configured to supply the liquid to the liquid consuming apparatus, the method comprising the steps of:

fitting the container body and the residual liquid quantity detecting unit by a fitting mechanism, which is provided in a region where the container body and the residual liquid quantity detecting unit are connected to each other, and which allows the container body and the residual liquid quantity detecting unit to relatively rotate so as to be detachably attached to each other;

coupling the container body and the residual liquid quantity detecting unit with each other by relatively rotating the container body and the residual liquid quantity detecting unit, after fitting the container body and the residual liquid quantity detecting unit by the fitting mechanism; and connecting the residual liquid quantity detecting unit and the liquid containing portion to each other, after coupling the container body and the residual liquid quantity detecting unit with each other.

8. A method of manufacturing a liquid container to be mounted in a liquid consuming apparatus, the liquid container having a container body that accommodates a liquid containing portion containing a liquid, the liquid containing portion provided with a connection port for leading out the liquid; and a residual liquid quantity detecting unit that is connected to the connection port so as to detect a residual amount of liquid remaining in the liquid containing portion, the residual liquid quantity detecting unit having a liquid lead-out portion configured to supply the liquid to the liquid consuming apparatus, the method comprising the steps of:

fitting the container body and the residual liquid quantity detecting unit by a fitting mechanism, which is provided in a region where the container body and the residual liquid quantity detecting unit are connected to each other, and which allows the container body and the residual liquid quantity detecting unit to relatively rotate so as to be detachably attached to each other;

coupling the container body and the residual liquid quantity detecting unit with each other by relatively rotating the container body and the residual liquid quantity detecting unit, after fitting the container body and the residual liquid quantity detecting unit by the fitting mechanism; and connecting the residual liquid quantity detecting unit and the liquid containing portion to each other, after coupling the container body and the residual liquid quantity detecting unit with each other;

wherein the container body is formed with an opening through which the connection port and a connection needle formed in the residual liquid quantity detecting unit are connected to each other, the connection needle is in an eccentric state position where the connection needle deviates from a center of the opening, when the container body and the residual liquid quantity detecting unit are fitted to each other by the fitting mechanism, and the connection needle is in a center state position where the connection needle is located at the center of the opening, when the container body and the residual liquid quantity detecting unit are coupled with each other.

* * * * *